US005280274A

United States Patent [19]

Uemura et al.

[11] Patent Number: 5,280,274

[45] Date of Patent: Jan. 18, 1994

[54] METHOD OF DETECTING RESIDUAL AMOUNT OF WEB ROLL

[75] Inventors: Hisashi Uemura, Nishinomiya; Setsuo Sasabe, Osaka; Takayasu Hongo, Kobe, all of Japan

[73] Assignee: Kanzaki Paper Manufacturing Co., Ltd., Tokyo, Japan

[21] Appl. No.: 858,555

[22] Filed: Mar. 27, 1992

[30] Foreign Application Priority Data

Mar. 29, 1991 [JP] Japan ..... 3-093284

[51] Int. Cl.[5] ..... G08B 21/00

[52] U.S. Cl. ..... 340/675; 226/11; 226/100; 242/57

[58] Field of Search ..... 340/675; 226/11, 100; 242/57

[56] References Cited

U.S. PATENT DOCUMENTS 3,820,101 6/1974 Bolick, Jr. ..... 340/675
4,157,575 6/1979 Satoh et al. ..... 340/675
4,204,180 5/1980 Usui et al. ..... 340/675
4,338,645 7/1982 Mohri et al. ..... 340/675
4,970,531 11/1990 Shimizu et al. ..... 242/57
4,994,851 2/1991 Iwai ..... 242/57

*Primary Examiner*—Glen R. Swann, III
*Attorney, Agent, or Firm*—Morgan & Finnegan

[57] ABSTRACT

A method of measuring and expressing the unwound amount or residual amount of a web roll, such as carbon film roll or printing paper roll in terms of a unit length of the web roll includes the steps of: starting a count of pulses to be produced by a rotation displacement detecting sensor for each predetermined angle of rotational displacement when the residual amount of the web roll is considered to have been reduced to a predetermined value; and emitting a warning signal when the count reaches a predetermined count number (initially set on the basis of the average value of the amounts of unwinding rotation of the web roll per unit length) during the time when the web roll is unwound and fed by a unit length from the count start time.

2 Claims, 3 Drawing Sheets

METHOD OF DETECTING RESIDUAL AMOUNT OF WEB ROLL

BACKGROUND OF THE INVENTION

The present invention relates to a method for detecting the residual amount of a web roll, such as a carbon film roll or printing paper roll wound in roll form in a printer.

In a conventional transfer thermal printer, the unwound length of a carbon roll, for example, is automatically measured, and upon exhaustion of the roll, a warning is issued; however, it takes a substantial time to perform an operation for preparing the next carbon film roll for exchange and, as described above the user is normally given a warning, when the printer is already stopped. Further, there are cases in which there is no fresh roll at hand and the handling thereof is postponed because of the absence of time to do so, thereby rendering the printer inoperable.

The present invention is intended to provide a method of issuing a warning before carbon film roll or the like is exhausted so as to eliminate the above drawback encountered when no warning is issued unless such roll is completely expended.

SUMMARY OF THE INVENTION

To achieve the above object, the invention provides a method of measuring and expressing the unwound amount or residual amount of a web roll, such as carbon film roll or printing paper roll in a length of unit, the method comprising the steps of: starting the count of pulses to be produced by a rotational displacement detecting sensor for each predetermined angle or rotational displacement, when the residual amount of the web roll is considered to have been reduced to a predetermined value, and emitting a warning signal when said count reaches a predetermined count number initially set on the basis of the average value of the amounts of unwinding rotation of the web roll per unit length, during the time when said web roll is unwound and fed by a unit length from the count start time.

Further, the present invention provides a method of measuring the residual amount of a web roll in a printer or the like, wherein the predetermined count number is set again to initiate a new count cycle, after the warning signal is issued or the predetermined count is not reached even after the feeding of the web roll in the unit length.

According to the first arrangement described above, the unwound amount of the web roll is measured by automatic measuring means and a warning count is started when the roll diameter is, e.g., 1.1 times as large as the winding core diameter, with the residual amount of the web roll taken as a predetermined amount serving as a reference value, and a warning emitted when the count of pulse signals from a rotational displacement detecting sensor associated with the roll shaft reaches a predetermined value, i.e., the predetermined count value roughly corresponding to the unit unwound length of the roll, during the feeding of a unit length of the printing paper.

Further, according to the second arrangement described above, when the feeding of a unit length of the printing paper is performed subsequent to the warning or conversely, before the count reaches the predetermined value, the next count cycle is started.

In addition, the fact that the roll diameter is 1.1 times as large as the winding core diameter means that with the winding core diameter expressed by D, the residual wound layer thickness is nearly $(1.1-1.0)\ D/2=0.05\ D$, and dividing this value by the thickness t (including an allowance for the winding superposition), or $0.05\ D/t$, gives the number of residual turns. Typically, if the winding core diameter D is 40 mm and the thickness t is about 0.1 mm, then $0.05\ D/t=20$ (turns). In this case, if the diameter D for all wound layers is nearly $D=43$ mm, then the residual length of the web is $20\times 43\ \pi$; therefore, the remainder is 2.7 m, a sufficient length to be used several minutes more even in a frequently used printer. On the other hand, as for the relation between the count of 50 pulses and the web length (measured by the printing paper), if the set count is 50 and the number of pulses per revolution of the roll is 8, then this corresponds to 6.25 revolutions. Therefore, from 2700 (length of remainder measured in mm)$\div$844(relation between pulse count of 50 and web length measured in mm, equal to 6.25 revolutions $\times\pi\times$ diameter (D)=43 mm)=3.2, the warning signal is produced 3 times before the web is exhausted.

EMBODIMENTS OF THE INVENTION

Figure 1:
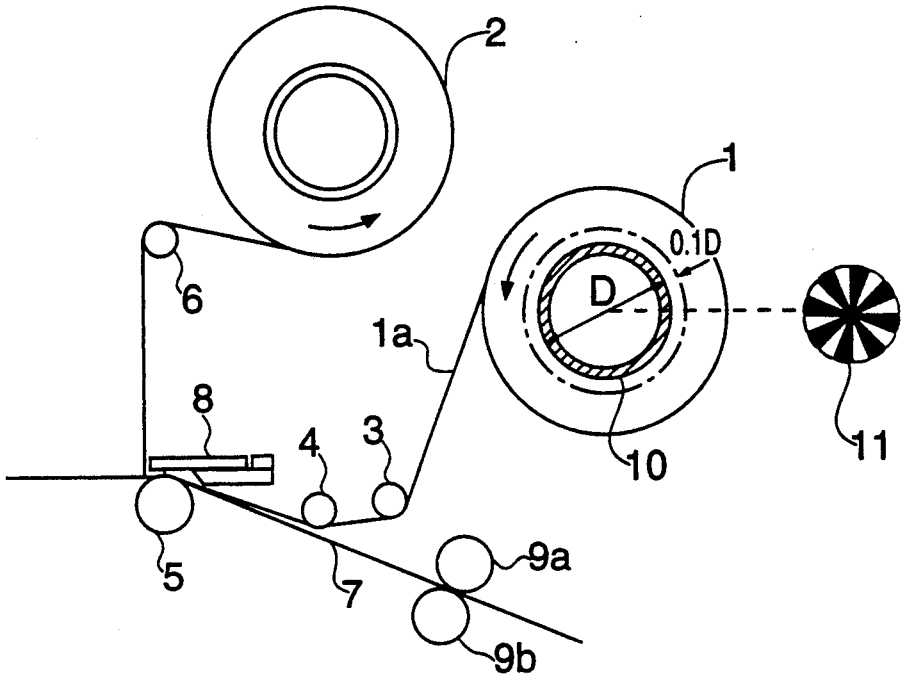
FIG. 1 is a schematic view showing an embodiment of the present invention applied to a carbon film roll.

FIG. 1 is a schematic view typically showing an embodiment of the present invention applied to a carbon film roll. The numeral 1 denotes a carbon film roll on the supply side, and 2 denotes a carbon film roll on the take-up side. The carbon web 1*a* withdrawn from the roll 1 passes over guide rolls 3 and 4 to a platen roll 5 and then over a guide roll 6 on the take-up side and is wound on the carbon film roll 2 on the take-up side. Printing paper 7 pressed against the lower surface of the carbon web 1*a* passes in contact with the platen roll 5. A thermal head 8 disposed on the front side of the carbon web 1*a* at this position. Selective driving of the thermal head 8 causes the carbon ink on the carbon web 1*a* to be transferred to the printing paper 7. The printing paper 7 is fed from a suitable source (not shown in FIG. 1) through a pair of feed rolls 9*a* and 9*b*. The shaft of the winding core 10 of the carbon film roll 1 on the feed side has a rotative sensor reflector 11 connected thereto. This reflector, in this embodiment, has 8 mirror sectors angularly equispaced on one surface thereof, and a light transmitter/receiver (not shown) is adapted to produce 8 pulses per revolution of the roll 1.

In this embodiment, suppose that the outer diameter D of the winding core 10 is 40 mm and that the thickness t of one layer of the carbon web 1*a* including an allowance is 0.1 mm, as described above. Then, when the diameter of the carbon film roll 1 on the supply side is 1.1 D with the number of residual turns being about 20, the pulse output of the rotative displacement sensor based on the rotation of the reflector 11 is counted, and each time when the count value reaches the set count number, e.g., 50, a warning is issued.

Figure 2:
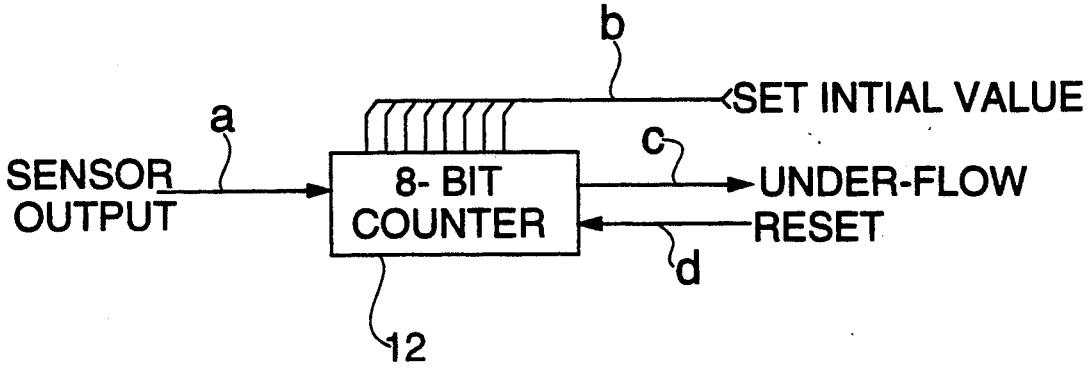
FIG. 2 is a schematic view of a counter applied to the embodiment shown in FIG. 1.

FIG. 2 shows a counter for counting the pulse output of the sensor. The counter 12 is an 8-bit counter, and a set count, e.g., 50, initially set through an initial value setting line b is counted down each time a pulse input from an input a is received. The character c denotes an underflow output terminal adapted to emit an underflow output signal when the set value 50 of the counter is counted down to zero, and in response to said output signal, a suitable warning circuit (not shown) is actuated. In addition, the character d denotes the reset terminal of the counter 12.

Figure 3:
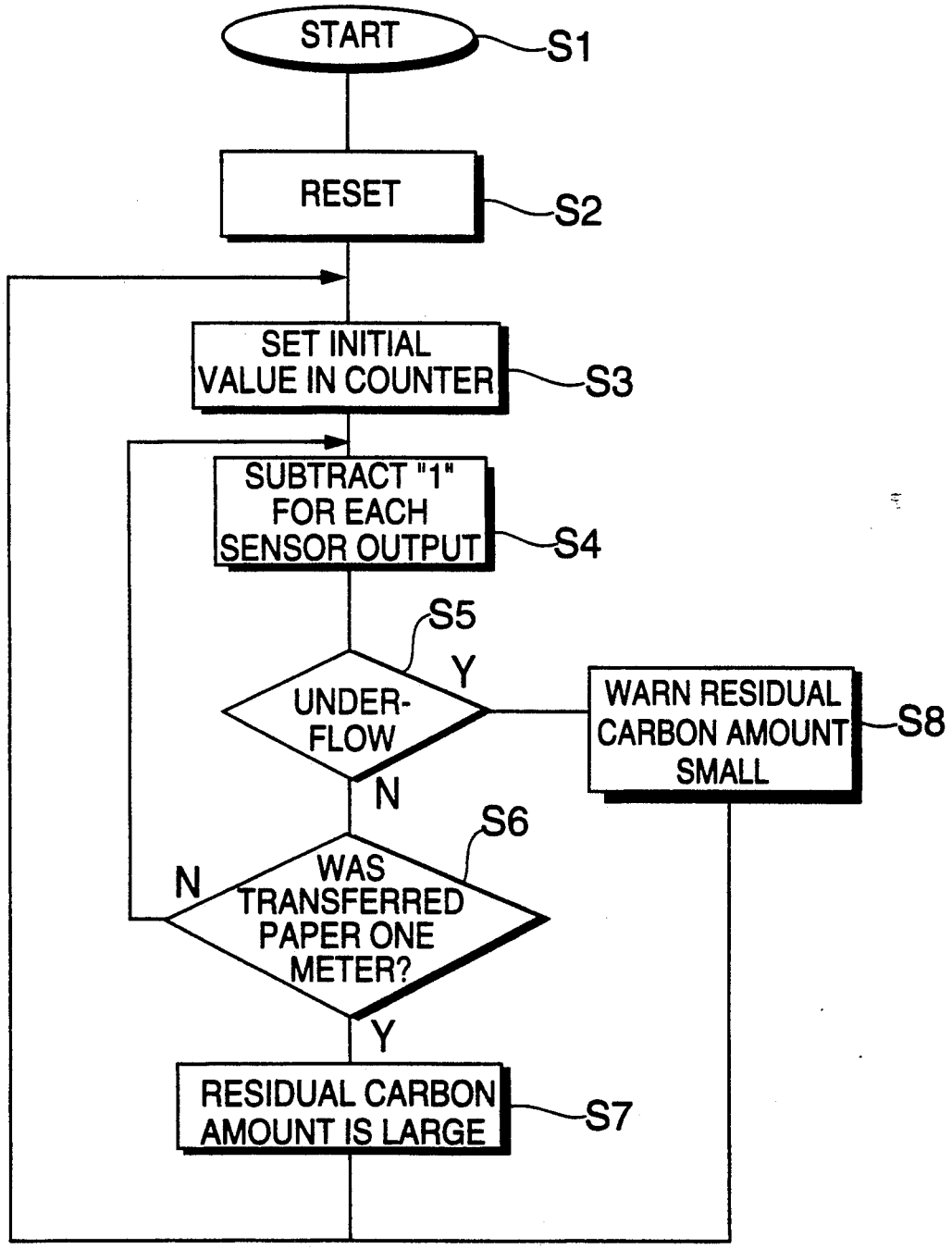
FIG. 3 is a flowchart showing a typical sequence operation in the embodiment.

FIG. 3 is a flowchart for the method of the present invention using the arrangement of the embodiment shown in FIGS. 1 and 2. The operations at the sequential steps are as follows.

Step S1: Start (when the carbon film roll diameter becomes 1.1 times as large as the winding core diameter).

Step S2: Reset the counter 12.

Step S3: Set a predetermined initial value (count set value), e.g., "50", in the counter 12.

Step S4: Subtract "1" from the counter initial value "50" for each output signal.

Step S5: Judge whether or not the counter has underflowed, that is, the count has become zero, and go to step S6 if it has not underflowed.

Step 6: Judge whether or not the printing paper has been fed by one meter more, and if the amount fed is less than one meter, return to step S4, and if it is not less than one meter, go to step S7.

Step S7: The fact that the sequence has entered this step S7 means that the web pressed against the printing paper 7 has also been fed by one meter after the start of the check with the counter 12 not having underflowed; therefore, a signal is emitted to the effect that the web roll has a sufficient residual amount, instructing that the counter 12 should be reset, and the sequence is returned to step S3. Therefore, at this stage, the countdown from the aforesaid initial value is restarted.

Step S8: When the occurrence of underflow has been ascertained through said steps S3 and S4, a warning signal indicating that the residual carbon amount is small is produced at this step S8. Thereby the user ascertains that a roll exchange is required, and he can prepare the next carbon film roll. And in order to enter the next warning cycle so that the preparation of a roll may not be overlooked for the first warning until the roll is exhausted, the sequence is returned to step S3 as in the case of step S7.

Figure 4:
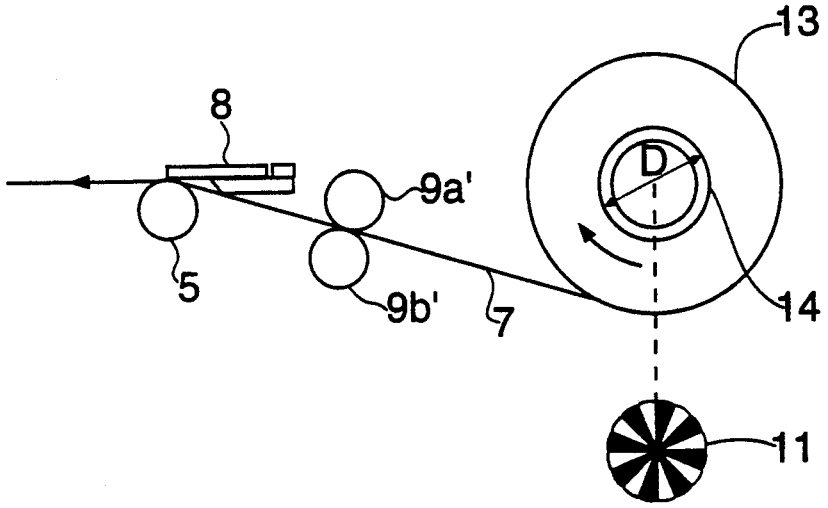
FIG. 4 is a schematic view showing an embodiment of the invention applied to a printing paper.

FIG. 4 shows an embodiment of the invention wherein the method of the invention is applied to a printing paper roll. The numeral 13 denotes a roll of printing paper, and the printing paper 7 withdrawn from said roll is passed over a pair of feed rolls 9*a'* and 9*b'* and between a heat sensitive head 8 and a platen roll 5 similar to the one shown in FIG. 1. The driving shaft of the core 14 of the roll 13 has a sensor reflector 11 mounted thereon similar to the one shown in FIG. 1, said reflector being adapted to produce a predetermined rotative angle displacement (in this case, 8 pulses per revolution). The sequence operation of this embodiment is the same as described above with reference to FIG. 3; thus, a warning signal is produced to notify the user of the need for exchanging the paper feed roll 13.

As has been described so far, the present invention produces a warning is produced as to the residual amount necessary for the exchange of a carbon film roll or the like in a transfer thermal printer; thus, the invention is useful for increasing the operation rate and efficiency.

What is claimed is:

1. A method of measuring and expressing the unwound amount or residual amount of a web roll wound on a winding core, such as carbon film roll or printing paper roll, in terms of a unit length, said method comprising the steps of: starting a count of pulses to be produced by a rotational displacement detecting sensor for each predetermined angle of rotational displacement of said web roll, said count being initiated when the diameter of said web roll has been measured to a certain preset factor of the diameter of said winding core, said diameter of said web roll being correlated to a predetermined residual amount of the web roll; and warning when said count reaches a predetermined count number (initially set on the basis of the average value of the amounts of unwinding rotation of said web roll per unit length) during the time when said web roll is unwound and fed by a unit length from the count start time.

2. A method as set forth in claim 1, characterized in that said predetermined count number is reset to initiate a new count cycle either after said warning or when a prior predetermined count is not reached even after the feeding of the unit length of said web roll.

* * * * *